US006247866B1

(12) United States Patent
Moro

(10) Patent No.: US 6,247,866 B1
(45) Date of Patent: Jun. 19, 2001

(54) FEEDING DUCTS FOR WRITING LIQUIDS IN FOUNTAIN PEN NIBS, AND A METHOD OF PRODUCING SAME

(76) Inventor: Camillo Moro, Via Zanon, 26, Padova (IT), 35133

( * ) Notice: Subject to any disclaimer, the term of this patent is extended or adjusted under 35 U.S.C. 154(b) by 0 days.

(21) Appl. No.: 08/381,886

(22) PCT Filed: Mar. 11, 1993

(86) PCT No.: PCT/EP93/00561

§ 371 Date: Feb. 22, 1995

§ 102(e) Date: Feb. 22, 1995

(87) PCT Pub. No.: WO94/08798

PCT Pub. Date: Apr. 28, 1994

(30) Foreign Application Priority Data

Oct. 9, 1992 (IT) ..... VE92A0043

(51) Int. Cl.[7] ..... B43K 1/00; B43K 1/02

(52) U.S. Cl. ..... 401/225; 401/199; 401/227; 401/228; 401/229

(58) Field of Search ..... 401/227, 228, 401/229, 225, 199

(56) References Cited

U.S. PATENT DOCUMENTS 5,087,144 * 2/1992 Wada et al. ..... 401/227

FOREIGN PATENT DOCUMENTS

1214113 * 4/1966 (DE) ..... 401/227
3931161 * 3/1991 (DE) ..... 401/227
0380696 8/1990 (EP) .
1570203 4/1969 (FR) .
2310226 12/1976 (FR) .
1183713 * 3/1970 (GB) ..... 401/225
2122953 1/1984 (GB) .

* cited by examiner

*Primary Examiner*—Steven A. Bratlie
(74) *Attorney, Agent, or Firm*—Hoffman, Wasson & Gitler

(57) ABSTRACT

A feeding duct for writing liquid in fountain pen nibs and method of producing same, wherein the duct includes a substantially cylindrical element having multiple circumferential grooves creating respective fins, of a support for a nib and a connecting mans to an ink reservoir the feeding duct is produced in two distinct portions disposed symmetrically in relation to a longitudinal plane each portion is provided with a longitudinal recess extending along the entire length of the portion, apart from the front end thereof, and is combined with recess of the other portion to form a groove when the two portions are secured one to another.

6 Claims, 3 Drawing Sheets

FEEDING DUCTS FOR WRITING LIQUIDS IN FOUNTAIN PEN NIBS, AND A METHOD OF PRODUCING SAME

FIELD OF THE INVENTION

The present invention relates to a method for producing feeding ducts for writing liquids, particularly for fountain pen nibs, and a duct obtained by the method.

BACKGROUND OF THE INVENTION

Ink ducts are known for the nib of a fountain pen. Such ducts generally consist of a plastic cylindrical element and are provided with a plurality of circumferential grooves, defining respective fins, and with a longitudinal groove approximately 1 mm deep and 0.1–0.15 mm wide providing the channel through which ink is fed to the nib.

The longitudinal groove in question, which doesn't extend along the entire length of the duct and substantially ends at the juncture of the application zone of the nib, is formed during the moulding operation by positioning a laminar insert, of corresponding dimensions, internally of the mold.

These known ink ducts present certain drawbacks, and in particular:

- a constructionally laborious method of fashioning the longitudinal groove, due to the small dimensions of the laminar insert, which can become displaced during injection of the plastic material; and
- a certain difficulty in utilizing multiple impression moulds, likewise due to the small dimensions of the laminar inserts which are subject to varying pressures.

BRIEF DISCUSSION OF THE PRIOR ART

FR-A-1570203 relates to an absorbing element consisting of two half portions to be connected through capillary systems to the support for a nib and to a reservoir.

EP-A-0380696 relates to a reservoir for storing ink temporarily in accordance with the variation of the pressure and temperature in an ink tank.

Fr-A-2310226 relates to a plastic nib for a fountain pen, provided with a longitudinal capillary.

SUMMARY OF THE INVENTION

The aim of the present invention is to produce a feeding duct for writing liquid in a simple, easy and cheap way.

According to the invention such an aim is attained through a method of producing feeding ducts for writing liquids, particularly for fountain pen nibs, wherein the duct consists of a substantially cylindrical element having a plurality of circumferential grooves serving to create respective fins, of a support for a nib and of a connecting means to an ink reservoir. The feeding duct has two distinct portions disposed symmetrically in relation to a longitudinal plane, and each portion has a longitudinal recess extending along the entire length of the portion apart from the front end thereof. The portions combine so that the recess of the portion form a groove when the two portions are secured one to another.

The present invention also has a feeding duct comprising a substantially cylindrical element having a plurality of circumferential grooves, which create respective fins, of a support for a nib and of a connecting means for an ink reservoir. The feeding duct formed from two distinct portions, disposed symmetrically in relation to a longitudinal plane, which can be secured one to another, and each portion is provided with a longitudinal recess extending along the entire length of the portion apart from the front end thereof. The two portions attach so that the recess of the portions form a groove when the portions are secured one to another.

BRIEF DESCRIPTION OF THE DRAWINGS

Preferred embodiments of the present invention will now be described in detail, with reference to the accompanying sheet of drawings, in which.

DESCRIPTION OF THE PREFERRED EMBODIMENTS

Figure 1:
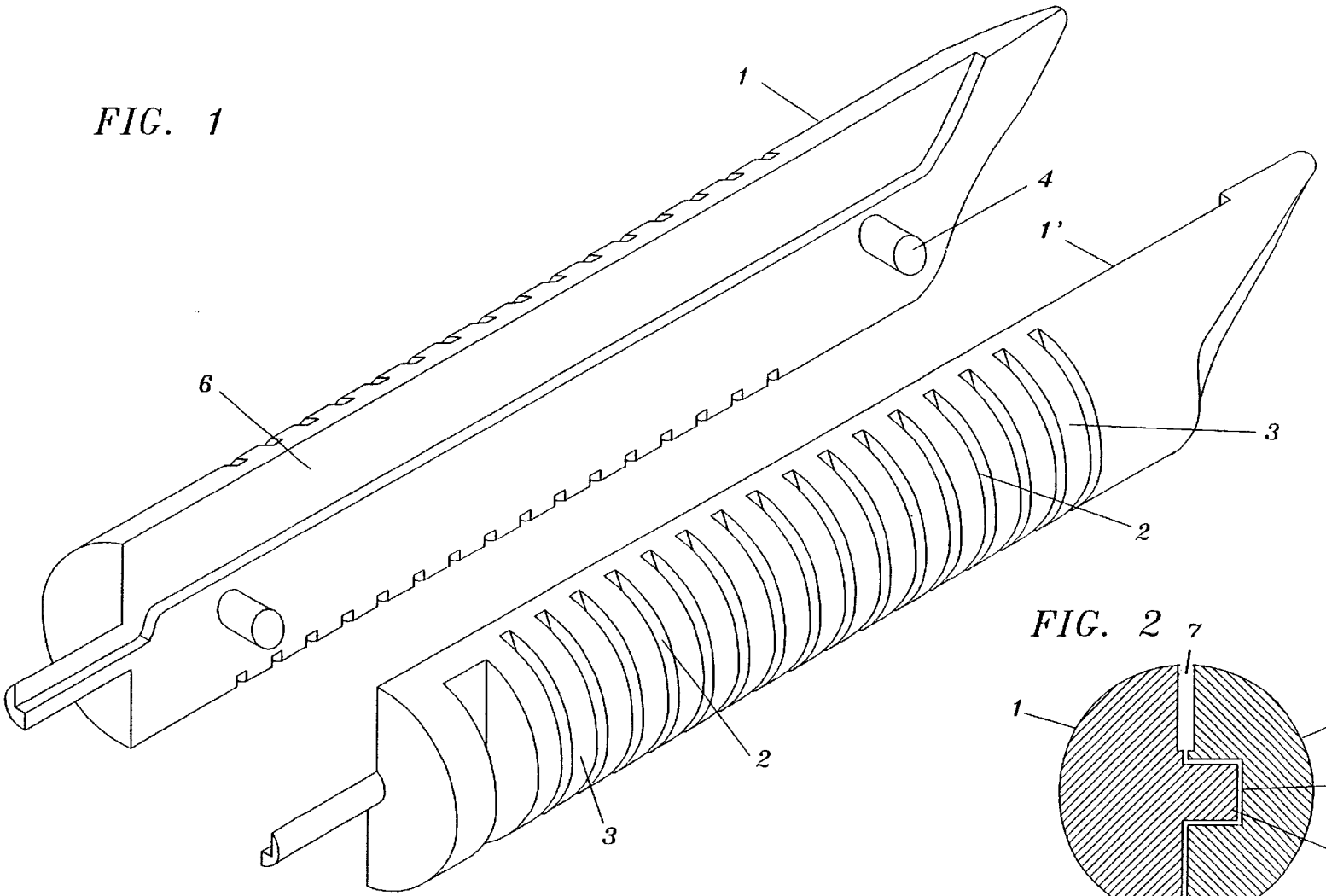
FIG. 1 is a perspective exploded view of an ink duct according to the invention.
Figure 2:
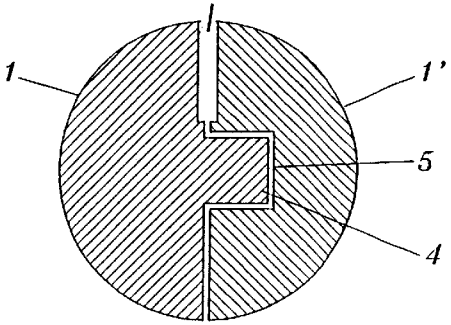
FIG. 2 shows the duct in cross section.

As can be seen from the drawings, the ink duct for fountain pen nibs according to the invention consists of a substantially cylindrical element formed from two distinct portions 1 and 1', disposed symmetrically in relation to a longitudinal plane.

The lateral surface of each semicylindrical portion 1 and 1' has a plurality of grooves 2 which create a plurality of respective fins 3 serving to retain the ink.

In addition, one portion 1 is provided with studs 4 insertable in corresponding sockets 5 formed in the other portion 1'.

Each portion 1 (1') has its flat surface provided with a longitudinal recess 6 extending substantially along the entire length of one edge of the portion, apart from the front end thereof, and combines with the recess 6 of the other portion 1' (1) to create a groove 7 along which ink is fed to the nib of the pen.

According to the invention, the ink duct is produced utilizing a mold where one die provides two impressions corresponding to the external shape of the two portions 1 and 1', and the remaining die provides two ribs to form the two parts of longitudinal continuous recess 6 during the moulding operation. The latter die also affords two holes and two pins, by which the studs 4 and the sockets 5 are formed in the two portions 1 and 1'.

It will be clear from the foregoing that the method of producing pen nib ink ducts according to the invention presents numerous advantages, in particular:

- the use of a constructionally simple mould that can be embodied with multiple impressions and does not require the interposition of laminar inserts;
- a qualitatively better product due to the fact that grooves of greater depth are obtainable.

Moreover it has been surprisingly observed that the writing action of a nib fitted to the ink duct according to the invention is more cushioned and freer from vibrations than that of the same nib when fitted to a conventional duct.

Figure 3:
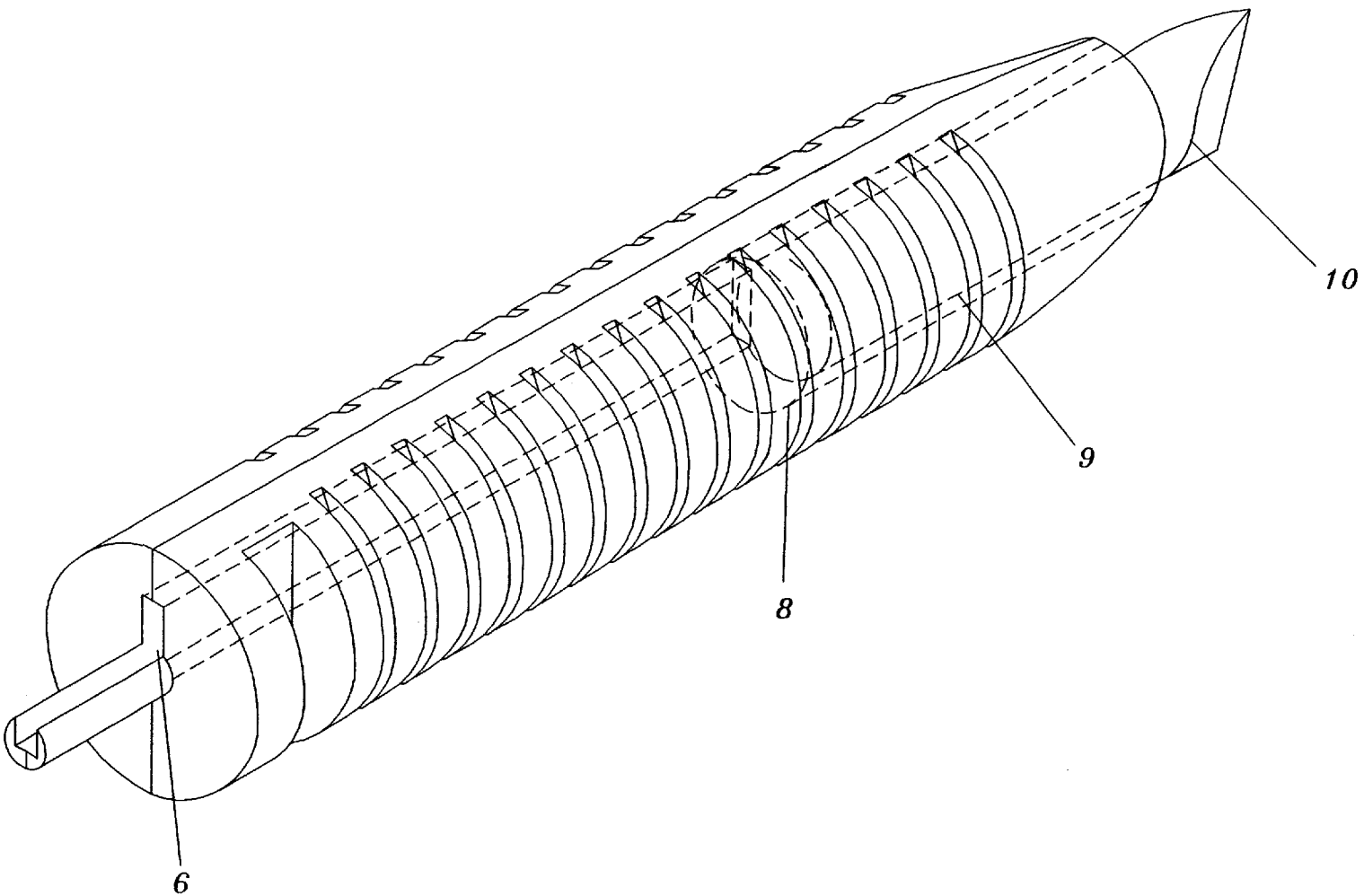
FIG. 3 shows it in the embodiment as fiber pen or high lighter.

In the embodiment shown in FIG. 3 the groove 7 is made inside the duct and comunicates with a seat 8 having suitable size to house a fiber point 9 with one end 10 projecting outwards the duct.

Figure 4:
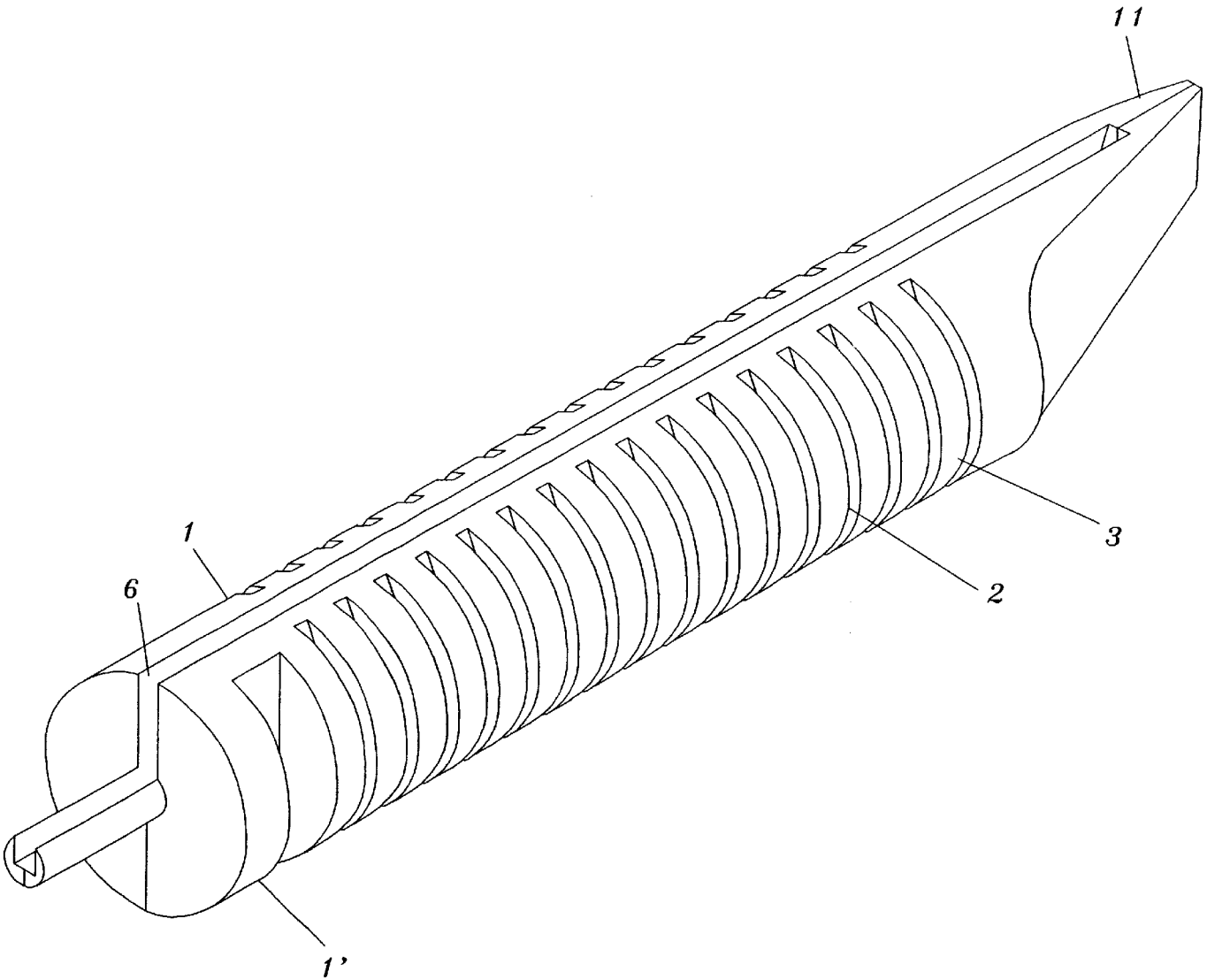
FIG. 4 shows it in the embodiment as liner.

In the embodiment shown in FIG. 4 the front end of the duct is suitably shaped to form a liner, the function of which the nib generally carries out. This is due to the fact that, even if the groove doesn't extend along the entire length of the duct, in any case it is possible to space apart the two portions 1, 11 in correspondence of their front ends by pressing them on the writing surface and to let the ink fall.

It is also foreseen to provide the front end of the two portions 11 with a seat suitable to house a sphere for a so called "roller" writing system.

I claim:

1. A feeding duct comprising:

a substantially cylindrical element having a plurality of circumferential grooves forming fins, a support for a nib and a connecting means for an ink reservoir, wherein said cylindrical element is formed from two distinct portions disposed symmetrically in relation to a longitudinal plane, said two portions being capable of attachment to one another, and wherein each of said two portions is provided with a longitudinal recess extending along an entire length of each of said two portions except for a front end of each said two portions, so that each recess of said two portions combines with an opposing recess of a second of said two portions to form a groove when said two portions are secured one to another.

2. A feeding duct as claimed in claim 1, wherein one of said two portions has studs insertable in respective sockets provided in another of said two portions.

3. A feeding duct as claimed in claim 1 wherein said front end is nib-shaped.

4. A feeding duct as claimed in claim 1 wherein said recess is disposed on an inside of said duct and communicates with a seat in which a fiber point is housed which a front end of said fiber point projects from said duct and is high-lighter shaped.

5. A method of producing a feeding duct for writing liquids, for fountain pen nibs, wherein said feeding duct includes substantially cylindrical element having a plurality of circumferential grooves forming fins, a support for a nib and a connecting means to an ink reservoir, comprising the steps of:

producing said feeding duct in two distinct portions disposed symmetrically in relation to a longitudinal plane, providing each of said two portions with a longitudinal recess extending along an entire length of each of said two portions except for a front end of each of said two portions;

and connecting said two portions so that said recess in each of said two portions form a groove when said two portions are secured one to another.

6. A method as claimed in claim 5, further comprising the step of providing said two portions with cooperating means by which to secure said portions.

* * * * *